US009303907B2

(12) United States Patent
Kawano et al.

(10) Patent No.: US 9,303,907 B2
(45) Date of Patent: Apr. 5, 2016

(54) REFRIGERANT CHARGING DEVICE, REFRIGERATION DEVICE AND REFRIGERANT CHARGING METHOD

(75) Inventors: Satoshi Kawano, Sakai (JP); Masahiro Oka, Sakai (JP); Kazuhiko Tani, Sakai (JP); Atsushi Okamoto, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 939 days.

(21) Appl. No.: 12/593,592

(22) PCT Filed: Apr. 7, 2008

(86) PCT No.: PCT/JP2008/056892

§ 371 (c)(1),
(2), (4) Date: Sep. 28, 2009

(87) PCT Pub. No.: WO2008/132982

PCT Pub. Date: Nov. 6, 2008

(65) Prior Publication Data

US 2010/0107660 A1 May 6, 2010

(30) Foreign Application Priority Data

Apr. 13, 2007 (JP) ..... 2007-105744

(51) Int. Cl.
*F25B 45/00* (2006.01)
*F25B 41/00* (2006.01)

(52) U.S. Cl.
CPC ..... *F25B 45/00* (2013.01); *F25B 2345/001* (2013.01); *F25B 2600/2515* (2013.01); *F25B 2700/1933* (2013.01); *F25B 2700/2106* (2013.01)

(58) Field of Classification Search
CPC ..... F25B 45/00; F25B 2345/001; F25B 2700/2106; F25B 2600/2515; F25B 2700/1933
USPC ..... 62/77, 208, 209, 210, 292
See application file for complete search history.

(56) References Cited

U.S. PATENT DOCUMENTS 2,273,213 A * 2/1942 McCloy ..... 62/77
3,400,552 A * 9/1968 Johnson et al. ..... 62/149
3,813,893 A 6/1974 Gemender et al.
3,873,289 A * 3/1975 White ..... 62/149

(Continued)

FOREIGN PATENT DOCUMENTS

JP 4-240365 A 8/1992
JP 2000-274891 A 10/2000

(Continued)

*Primary Examiner* — Frantz Jules
*Assistant Examiner* — Claire Rojohn, III
(74) *Attorney, Agent, or Firm* — Birch, Stewart, Kolasch & Birch, LLP

(57) ABSTRACT

An electric valve is provided in a supply pipe. A flow rate control unit controls the degree of opening of the electric valve such that the flow rate in the supply pipe lies within a predetermined range, on the basis of a pressure difference between pressure of refrigerant supplied to the supply pipe and the pressure of refrigerant on the suction side of a compressor. An outdoor air temperature sensor detects outdoor air temperature; and a low-pressure side pressure sensor detects refrigerant pressure on the suction side of the compressor. The pressure difference is a difference between a saturation pressure corresponding to the outdoor air temperature detected by the outdoor air temperature sensor and refrigerant pressure detected by the low-pressure side pressure sensor.

10 Claims, 4 Drawing Sheets

(56) References Cited

U.S. PATENT DOCUMENTS 3,875,755 A * 4/1975 Anderson et al. ..... 62/77
4,106,306 A * 8/1978 Saunders ..... F25B 45/00 62/149
4,220,010 A * 9/1980 Mueller et al. ..... 62/126
4,262,491 A * 4/1981 Chorey et al. ..... 62/185
4,340,030 A * 7/1982 Molivadas ..... F24J 2/204 126/572
4,407,141 A * 10/1983 Paddock ..... 62/130
4,484,452 A * 11/1984 Houser, Jr. ..... 62/174
4,487,028 A * 12/1984 Foye ..... 62/115
4,638,643 A * 1/1987 Sakazume et al. ..... 62/209
4,653,288 A * 3/1987 Sayo et al. ..... 62/210
4,805,416 A * 2/1989 Manz et al. ..... 62/292
4,939,905 A * 7/1990 Manz ..... 62/77
5,022,232 A * 6/1991 Sakamoto et al. ..... 62/133
5,070,705 A * 12/1991 Goodson et al. ..... 62/197
5,127,232 A * 7/1992 Paige et al. ..... 62/77
5,146,761 A * 9/1992 Cavanaugh et al. ..... 62/149
5,172,562 A * 12/1992 Manz et al. ..... 62/149
5,174,124 A * 12/1992 Paige et al. ..... 62/125
5,201,188 A * 4/1993 Sakuma ..... 62/149
5,222,369 A * 6/1993 Hancock et al. ..... 62/149
5,231,841 A * 8/1993 McClelland et al. ..... 62/77
5,237,826 A * 8/1993 Baldwin et al. ..... 62/77
5,269,148 A * 12/1993 Ludwig ..... 62/77
5,272,882 A * 12/1993 Degier et al. ..... 62/77
5,317,903 A * 6/1994 McClelland et al. ..... 62/77
5,379,605 A * 1/1995 Outlaw et al. ..... 62/77
5,493,869 A * 2/1996 Shirley et al. ..... 62/149
RE35,235 E * 5/1996 Beckerman ..... 62/77
5,524,447 A * 6/1996 Shim ..... 62/209
5,533,345 A * 7/1996 Roth ..... 62/77
5,548,966 A * 8/1996 Tinsler ..... B60H 1/00585 62/149
5,709,091 A * 1/1998 Todack ..... 62/85
5,765,383 A * 6/1998 Inoue ..... 62/209
5,799,497 A * 9/1998 Sano et al. ..... 62/149
5,873,255 A * 2/1999 Madigan ..... 62/77
5,875,638 A * 3/1999 Tinsler ..... 62/149
5,907,953 A * 6/1999 Kang et al. ..... 62/89
5,910,160 A * 6/1999 Cakmakci et al. ..... 62/195
5,915,473 A * 6/1999 Ganesh et al. ..... 165/222
5,970,721 A * 10/1999 Kamimura ..... F25B 45/00 62/292
6,029,472 A * 2/2000 Galbreath, Sr. ..... 62/475
6,044,655 A * 4/2000 Ozaki et al. ..... 62/205
6,070,420 A * 6/2000 Biancardi et al. ..... 62/114
6,082,122 A * 7/2000 Madenokouji et al. ..... 62/77
6,134,899 A * 10/2000 Brown ..... B60H 1/00585 62/126
6,185,949 B1 * 2/2001 Madigan ..... 62/222
6,209,338 B1 * 4/2001 Thatcher, Jr. ..... 62/292
6,220,041 B1 * 4/2001 Okazaki et al. ..... 62/149
6,233,961 B1 * 5/2001 Ashida ..... F25B 45/00 62/292
6,244,055 B1 * 6/2001 Hanson ..... B60H 1/00585 62/149
6,321,549 B1 * 11/2001 Reason et al. ..... 62/223
6,467,289 B2 * 10/2002 Kuroki et al. ..... 62/201
6,505,476 B1 * 1/2003 Nishida et al. ..... 62/228.5
6,510,698 B2 * 1/2003 Kasai et al. ..... 62/77
6,560,980 B2 * 5/2003 Gustafson et al. ..... 62/186
6,662,577 B2 * 12/2003 Goth et al. ..... 62/129
6,698,216 B2 * 3/2004 Goth et al. ..... 62/150
6,779,356 B2 * 8/2004 Lee et al. ..... 62/204
6,845,626 B2 * 1/2005 Matsuoka ..... F25B 45/00 62/149
6,871,509 B2 * 3/2005 Grabon et al. ..... 62/201
6,910,341 B2 * 6/2005 Srichai et al. ..... 62/115
6,993,921 B2 * 2/2006 Eisenhower et al. ..... 62/209
7,104,076 B2 * 9/2006 Scarcella et al. ..... 62/84
7,174,742 B2 * 2/2007 Thomas et al. ..... 62/475
7,472,557 B2 * 1/2009 Kang ..... F25B 45/00 62/127
7,493,773 B2 * 2/2009 Beatenbough ..... F25B 45/00 62/149
7,500,368 B2 * 3/2009 Mowris ..... 62/149
7,562,536 B2 * 7/2009 Harrod et al. ..... 62/228.1
7,765,816 B2 * 8/2010 Okaza et al. ..... 62/158
7,793,513 B2 * 9/2010 Aldridge et al. ..... 62/263
7,823,397 B2 * 11/2010 Chang et al. ..... 62/129
7,878,006 B2 * 2/2011 Pham ..... 62/127
7,980,086 B2 * 7/2011 Kotani ..... F25B 45/00 62/127
7,997,093 B2 * 8/2011 Kasahara ..... 62/128
8,011,597 B2 * 9/2011 Phillippo ..... 236/91 C
8,020,395 B2 * 9/2011 Kotani et al. ..... 62/225
8,096,141 B2 * 1/2012 VanderZee ..... 62/225
8,109,104 B2 * 2/2012 Doll et al. ..... 62/129
8,171,747 B2 * 5/2012 Kurihara et al. ..... 62/222
8,176,743 B2 * 5/2012 Kurihara et al. ..... 62/205
8,181,480 B2 * 5/2012 Kasahara et al. ..... 62/498
8,191,793 B2 * 6/2012 Byquist et al. ..... 236/1 C
8,215,119 B2 * 7/2012 Sakai et al. ..... 62/77
2003/0074910 A1 * 4/2003 Moon et al. ..... 62/196.4
2003/0164000 A1 * 9/2003 Ohga et al. ..... 62/190
2003/0226367 A1 12/2003 Palmer et al.
2004/0035568 A1 * 2/2004 Katou et al. ..... 165/204
2004/0134224 A1 * 7/2004 Park et al. ..... 62/474
2004/0231352 A1 * 11/2004 Matsuoka et al. ..... 62/292
2004/0237578 A1 * 12/2004 Takegami et al. ..... 62/510
2005/0066684 A1 * 3/2005 Matsuoka ..... 62/470
2005/0081539 A1 * 4/2005 Hwang et al. ..... 62/160
2005/0097904 A1 * 5/2005 Lifson et al. ..... 62/149
2005/0235662 A1 * 10/2005 Pham ..... 62/126
2006/0117773 A1 * 6/2006 Street et al. ..... 62/213
2007/0006609 A1 * 1/2007 Thomas ..... F25B 45/00 62/475
2007/0180851 A1 * 8/2007 Fujiyoshi ..... F24F 3/1411 62/480
2009/0019872 A1 * 1/2009 Kotani ..... F25B 41/062 62/225

FOREIGN PATENT DOCUMENTS

JP 2001-74342 A 3/2001
JP 2005-114184 A 4/2005
JP 2005-241050 A 9/2005
JP 2005-241172 A 9/2005
JP 2006-10117 A 1/2006
JP 2006-207925 A 8/2006
JP WO 2007094343 A1 * 8/2007 ..... F25B 41/062

* cited by examiner

REFRIGERANT CHARGING DEVICE, REFRIGERATION DEVICE AND REFRIGERANT CHARGING METHOD

TECHNICAL FIELD

The present invention relates to a refrigerant charging device, a refrigeration device and a refrigerant charging method.

BACKGROUND ART

In conventional devices for charging refrigerant into a refrigerant circuit, a supply pipe is provided in refrigerant piping, on the suction side of a compression mechanism in a refrigerant circuit, such that refrigerant can be charged into the refrigerant circuit by connecting a cylinder to the supply pipe, as disclosed in Patent Document 1. In such a charging device, the refrigerant flows through the supply pipe into the refrigerant circuit, to be charged into the latter, in accordance with the pressure difference between the refrigerant pressure in the cylinder and the pressure in the suction side of the compression mechanism.

Patent Document 1: JP 2001-74342 A

However, such charging devices have the following drawback. The refrigerant is supplied on account of the pressure difference between the refrigerant pressure in the cylinder and the pressure on the suction side of the compression mechanism, and thus the charging speed of the refrigerant varies depending on this pressure difference. As a result, the charging speed of the refrigerant decreases when the pressure in the cylinder drops on account of, for instance, a lower outdoor air temperature. This results in a longer charging time, which is problematic.

SUMMARY OF THE INVENTION

Thus, it is an object of the present invention to allow suppressing variations in the charging time of a refrigerant into a refrigerant circuit.

The present invention is a refrigerant charging device which has a supply pipe connectable to refrigerant piping on a suction side of a compression mechanism in a refrigerant circuit, and which supplies refrigerant to the refrigerant circuit via the supply pipe, the refrigerant charging device including adjustment portion for adjusting a flow rate in the supply pipe to be within a predetermined range, based on a pressure difference between a pressure of refrigerant supplied to the supply pipe and a refrigerant pressure on the suction side of the compression mechanism.

DETAILED DESCRIPTION OF THE PREFERRED EMBODIMENTS OF THE INVENTION

A best mode for carrying out the invention is explained next in detail with reference to accompanying drawings.

Figure 1:
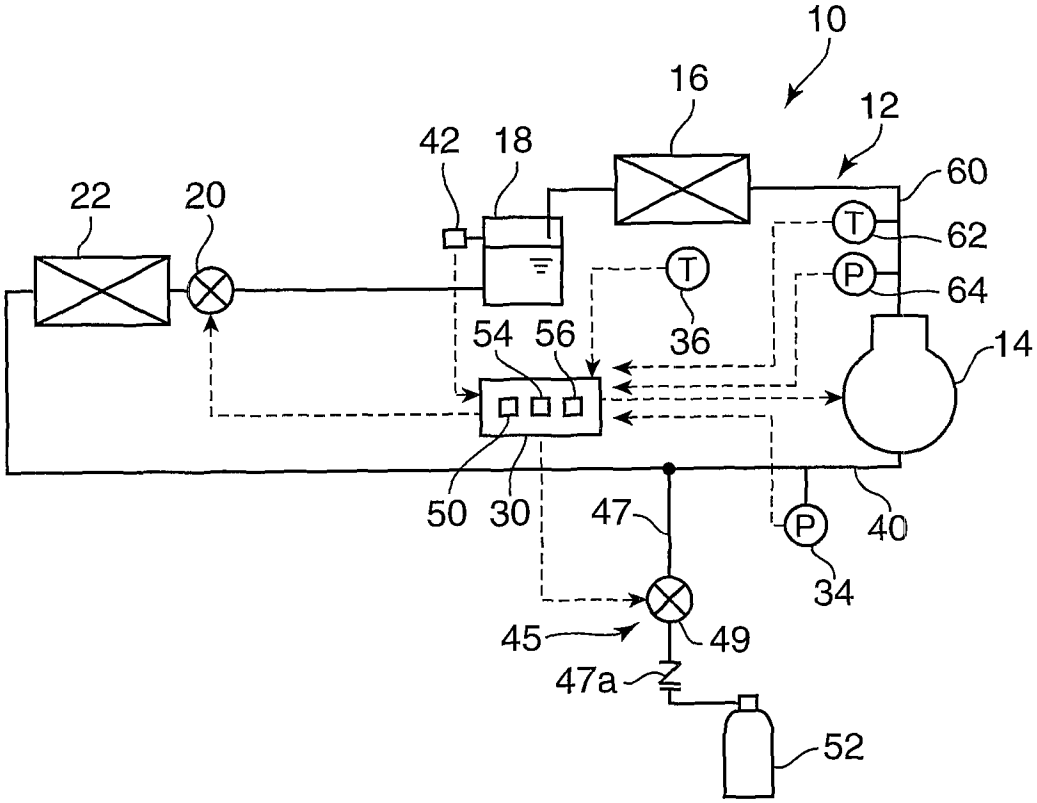
FIG. 1 is a diagram illustrating the schematic configuration of a refrigeration device according to an embodiment of the present invention.

FIG. 1 illustrates the schematic configuration of a refrigeration device used in one embodiment of a refrigerant charging device according to the present invention. As illustrated in the figure, a refrigeration device 10 comprises a refrigerant circuit 12 for circulating a refrigerant. The refrigerant circuit 12 is provided with, in this order, a compressor 14 functioning as a compression mechanism for compressing a refrigerant; an outdoor heat exchanger 16 functioning as a condenser; a tank 18 for storing the refrigerant; an expansion valve 20 functioning as an expansion mechanism, and an indoor heat exchanger 22 functioning as an evaporator.

The compressor 14, the expansion valve 20 and so forth are driven and controlled by a controller 30. The refrigerant circuit 12 is provided with various sensors such as a low-pressure side pressure sensor 34, a high-pressure side temperature sensor 62, a high-pressure side pressure sensor 64 and an outdoor air temperature sensor 36. Detection signals from the sensors 34, 62, 64 and 36 are inputted into the controller 30.

The low-pressure side pressure sensor 34 is provided in refrigerant piping 40, between the suction side of the compressor 14 and the indoor heat exchanger 22. The low-pressure side pressure sensor 34 is configured so as to be capable of detecting the pressure of the refrigerant flowing in the refrigerant piping 40. Through the refrigerant piping 40 there flows low pressure-side refrigerant the pressure of which is reduced by the expansion valve 20.

The above-mentioned outdoor air temperature sensor 36, as an outdoor air temperature detection means, is configured so as to be capable of detecting outdoor air temperature. The high-pressure side pressure sensor 64, as an example of a pressure detection means, is provided in refrigerant piping 60 between the discharge side (discharge section) of the compressor 14 and the outdoor heat exchanger 16. The high-pressure side pressure sensor 64 is configured so as to be capable of detecting the pressure of the refrigerant flowing in the refrigerant piping 60. Through the refrigerant piping 60 there flows high-pressure side refrigerant compressed by the compressor 14. The high-pressure side temperature sensor 62, as an example of a temperature detection means, is provided in the above-mentioned refrigerant piping 60. The high-pressure side temperature sensor 62 is configured so as to be capable of detecting the temperature of the refrigerant flowing in the refrigerant piping 60.

The detection signals of a level sensor 42, configured so as to be capable of detecting the liquid level in the tank 18, are also inputted into the controller 30. The level sensor 42 is provided in the tank 18.

A refrigerant charging device 45 according to the present embodiment is provided in the refrigerant piping 40 that connects the suction side (suction section) of the compressor 14 and the indoor heat exchanger 22. The refrigerant charging device 45 has the purpose of charging a predetermined amount of refrigerant into the refrigerant circuit 12 upon mounting of the refrigeration device 10 on the user's side (use site).

The refrigerant charging device 45 comprises a supply pipe 47 connected to the refrigerant piping 40, and adjustment means for adjusting the flow rate of refrigerant supplied to the refrigerant circuit 12 via the supply pipe 47. The supply pipe 47 is connected to the refrigerant piping 40 at a position more upstream (towards the indoor heat exchanger) than that of the low-pressure side pressure sensor 34.

The adjustment means comprises an electric valve 49 provided in the supply pipe 47, and a flow rate control unit 50 that controls the degree of opening of the electric valve 49. A supply port 47*a*, configured so as to be mountable on a refrigerant-holding cylinder 52, is provided at an end of the supply pipe 47. The electric valve 49 is disposed between the supply port 47*a* and the connection with the refrigerant piping 40. The electric valve 49 is configured in such a manner that, when a control signal from the flow rate control unit 50 is inputted into the electric valve 49, the opening area in the supply pipe 47 is modified through driving of a valve disc not shown.

The flow rate control unit 50 is comprised in the controller 30, to perform one of the functions of the latter. The flow rate control unit 50 is a control unit for adjusting the degree of opening of the electric valve 49 in such a manner that the flow rate in the supply pipe 47 lies within a predetermined range. Specifically, the flow rate control unit 50 calculates a pressure difference ΔP between the pressure of the refrigerant to be supplied to the supply pipe 47 and the refrigerant pressure on the suction side of the compressor 14. The controller 30 has stored therein data on the outdoor air temperature mapped to the saturation pressure thereof. The flow rate control unit 50 uses, as the pressure of the refrigerant to be supplied to the supply pipe 47, the saturation pressure corresponding to the outdoor air temperature that is detected by the outdoor air temperature sensor 36. The refrigerant pressure detected by the low-pressure side pressure sensor 34 is used as the refrigerant pressure on the suction side of the compressor 14.

Figure 2:
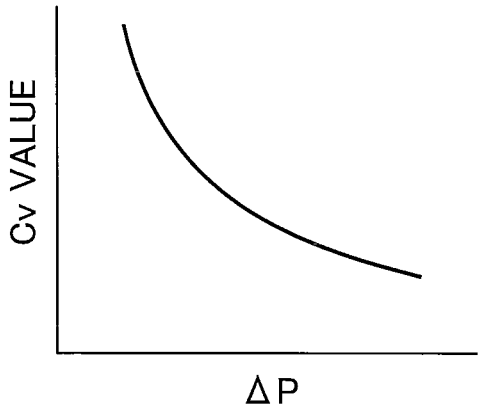
FIG. 2 is a characteristic diagram illustrating the relationship between pressure difference ΔP and Cv value.

The controller 30 has stored therein data on the pressure difference ΔP mapped to Cv values of the electric valve 49, as illustrated in FIG. 2. The figure depicts the Cv values, for a constant refrigerant flow rate, relative to the pressure difference ΔP between the pressure of the refrigerant to be supplied to the supply pipe 47 and the refrigerant pressure on the suction side of the compressor 14, i.e. the pressure difference ΔP between the inlet and the outlet of the supply pipe 47. The flow rate control unit 50 controls the degree of opening of the electric valve 49 in such a manner that the refrigerant flow rate lies within a predetermined range, using correlation data between the pressure difference ΔP and the Cv value. The Cv value is a flow rate coefficient that denotes the difficulty with which the refrigerant flows, and specifies the flow rate of refrigerant flowing at a predetermined temperature under valve opening conditions for which the differential pressure before and after the electric valve 49 is a predetermined pressure.

In addition to the flow rate control unit 50, the controller 30 has a correction control unit 54 and a charging completion control unit 56, and embodies the functions thereof. The purpose of the correction control unit 54 is to keep the amount of any liquefied refrigerant suctioned into the compressor 14 within a predetermined range. The correction control unit 54 corrects the degree of opening of the electric valve 49 in such a manner that the superheat of refrigerant compressed by the compressor 14 is equal to or greater than a predetermined value. Specifically, the correction control unit 54 derives, as the superheat SH of the discharge refrigerant, a temperature difference between the refrigerant temperature on the discharge side of the compressor 14, detected by the high-pressure side temperature sensor 62, and saturation temperature corresponding to refrigerant pressure on the discharge side of the compressor 14, detected by the high pressure side pressure sensor 64. The correction control unit 54 reduces the degree of opening of the electric valve 49 when the derived superheat SH drops below a first setting (lower limit) SH1, and increases the degree of opening of the electric valve 49 when the derived superheat SH exceeds a second setting (upper limit) SH2. The first setting SH1 and the second setting SH2 are set on the basis of, for instance, data measured experimentally beforehand. That is, the first setting SH1 is set on the basis of data acquired beforehand on the superheat on the discharge side of the compressor 14 at the time when the wetness of the refrigerant is sufficiently suppressed in such a manner that the compressor 14 is not damaged even if the refrigerant suctioned into the compressor 14 is partially wet. The first setting SH1 and the second setting SH2 may have the same value. Alternatively, the value of the second setting SH2 may be greater than that of the first setting SH1.

The purpose of the charging completion control unit 56 is to ensure that a predetermined amount of refrigerant is charged into the refrigerant circuit 12. When the charging completion control unit 56 determines that a predetermined amount of refrigerant is charged into the refrigerant circuit 12, the charging completion control unit 56 controls the compressor 14 to be stopped and the electric valve 49 to be closed. The electric valve 49 is closed since merely stopping the compressor 14 does not prevent refrigerant from keeping on flowing, on account of the differential pressure between the inlet and the outlet of the supply pipe 47. The charging completion control unit 56 determines whether a predetermined amount of refrigerant is charged depending on whether the level sensor 42, provided in the tank 18, detects that the liquid level is at a predetermined height.

Figure 3:
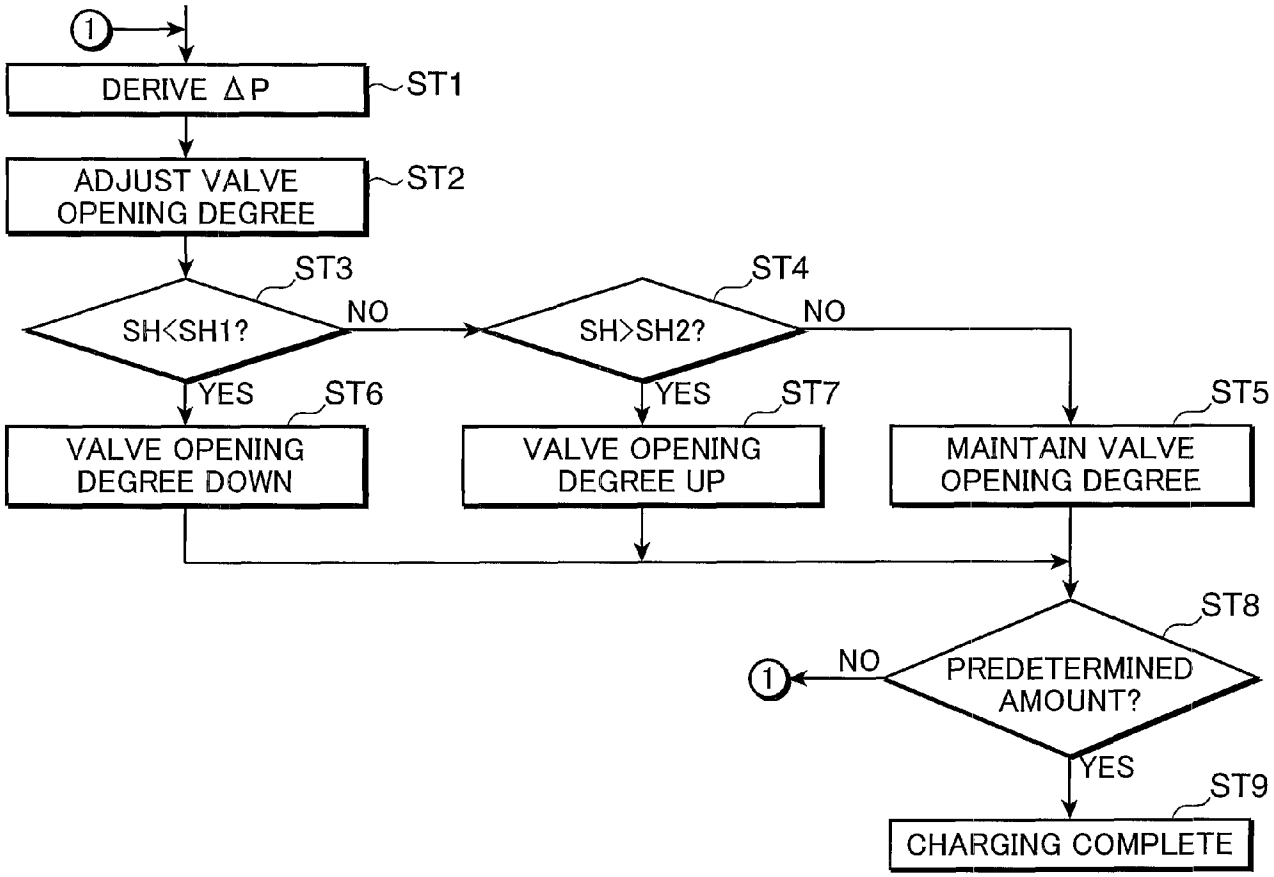
FIG. 3 is a flowchart illustrating a refrigerant charging operation in the refrigeration device.

With reference to FIG. 3, an explanation follows next on the refrigerant charging method in the refrigeration device 10 according to the present embodiment. To charge refrigerant into the refrigerant circuit 12 once the refrigeration device 10 has been installed, the refrigeration device 10 is started up first, the compressor 14 is driven at a predetermined number of revolutions, and the electric valve 49 is opened.

Driving of the compressor 14 elicits a suctioning action by the compressor 14 on the suction side of the compressor 14, which causes refrigerant from the cylinder 52 to be supplied to the refrigerant circuit 12 via the supply pipe 47. The pressure difference ΔP between the saturation pressure corresponding to the outdoor air temperature, detected by the outdoor air temperature sensor 36, and the refrigerant pressure, detected by the low-pressure side pressure sensor 34, is derived at this time (step ST1). There is also derived the Cv value at which the refrigerant flow rate in the supply pipe 47 is substantially constant, with respect to the pressure difference ΔP. The degree of opening of the electric valve 49 is adjusted to the valve degree of opening that corresponds to the Cv value (step ST2). As a result, the flow rate of refrigerant supplied to the refrigerant circuit 12 via the supply pipe 47 is kept within a predetermined range. Accordingly, it becomes possible to curtail drops in the flow rate by increasing the valve degree of opening when the flow rate of refrigerant supplied via the supply pipe 47 decreases on account of a drop in the pressure difference ΔP caused, for instance, by a fall in the outdoor air temperature.

The superheat of the discharge refrigerant is derived next. Specifically, the temperature difference between the value detected by the high-pressure side temperature sensor 62 (refrigerant temperature on discharge side of the compressor 14) and the saturation temperature corresponding to the value detected by the high-pressure side pressure sensor 64 (refrigerant pressure on the discharge side of the compressor 14) is derived as the superheat SH of the discharge refrigerant. It is then determined whether the superheat SH is equal to or greater than the first setting SH1 (step ST3). If the superheat SH is equal to or greater than the first setting SH1, the process moves on to step ST4, where it is determined whether the superheat SH is no greater than the second setting SH2. If the superheat SH is no greater than the second setting, the current state is maintained, without modifying the degree of opening (step ST5).

On the other hand, if in step ST3 the superheat SH is lower than the first setting SH1, the process moves on to step ST6, and the controller 30 throttles the electric valve 49. That is, when the superheat SH on the discharge side of the compressor 14 is lower than the first setting SH1, part of the refrigerant suctioned into the compressor 14 may liquefy. Therefore, throttling the electric valve 49 prevents liquid refrigerant from being suctioned to an extent that is damaging to the compressor 14.

When in step ST4 the superheat SH is higher than the second setting SH2, the process moves on to step ST7, and the controller 30 increases the degree of opening of the electric valve 49. This is equivalent to a case where the refrigerant flow rate is reduced through excessive throttling of the electric valve 49. Therefore, the degree of opening of the valve is increased, to increase thereby the flow rate. The variation in the valve degree of opening in step ST6 and ST7 may have a constant value, or a value that depends on the degree of opening of the valve.

In step ST8 it is determined whether a predetermined amount of refrigerant is charged into the refrigerant circuit 12. Steps ST1 to ST8 are repeated if that predetermined amount has not been reached. Whether the charging amount of refrigerant has reached or not a predetermined amount is determined by the level sensor 42 on the basis of whether a predetermined amount of refrigerant is stored in the tank 18. When the liquid level in the tank 18 is at a predetermined height, the compressor 14 is stopped and the electric valve 49 is closed (step ST9). A predetermined amount of refrigerant is charged into the refrigerant circuit 12 as a result.

In the present embodiment, as explained above, the refrigerant flow rate is adjusted by an adjustment means in such a manner that the refrigerant flow rate in the supply pipe 47 lies within a predetermined range, on the basis of the above-described pressure difference ΔP. This allows curtailing, as a result, a decrease in the flow rate that is supplied to the refrigerant piping 40, even in case of a drop of pressure in the refrigerant supplied to the supply pipe 47. Therefore, it becomes possible to curtail the drop in charging speed of the refrigerant also in circumstances where, for instance, there decreases the pressure difference between the pressure in the cylinder 52 and the pressure on the suction side of the compressor 14. This allows avoiding, as a result, a protracted charging time.

In the present embodiment, moreover, the pressure of the refrigerant supplied to the supply pipe 47 is estimated based on the detection values of the outdoor air temperature sensor 36. Therefore, the refrigerant flow rate can be adjusted even if there is provided no means for detecting the pressure of the refrigerant that is supplied to the supply pipe 47. For instance, the temperature in the cylinder 52 that is filled with refrigerant is arguably substantially the same as the outdoor air temperature. Accordingly, the pressure (saturation pressure) of the refrigerant that is supplied from the cylinder 52 to the supply pipe 47 can be estimated if the outdoor air temperature can be known beforehand.

In the present embodiment, moreover, the degree of opening of the electric valve 49 controlled by the flow rate control unit 50 is corrected by the correction control unit 54 in such a manner that the superheat SH of the refrigerant on the discharge side of the compressor 14 is equal to or greater than a predetermined value SH1. As a result, refrigerant wetness occurring on the suction side of the compressor 14 can be kept within a predetermined wetness range.

In the present embodiment, moreover, the degree of opening of the electric valve 49 is increased when the superheat SH of the refrigerant reaches an upper limit SH2. The superheat SH of the refrigerant can be kept thereby within a predetermined range. This allows securing a predetermined superheat while preventing an excessive drop in the flow rate of refrigerant being supplied through the supply pipe 47.

In the present embodiment, also, the superheat SH is derived on the basis of the refrigerant temperature on the discharge side of the compressor 14 and saturation temperature corresponding to refrigerant pressure. Accordingly, the superheat of refrigerant can be derived using the high-pressure side temperature sensor 62 and the high-pressure side pressure sensor 64 provided on the discharge side of the compressor 14.

In the present embodiment, moreover, the electric valve 49 is closed when a predetermined amount of refrigerant is charged. This allows charging a necessary amount of refrigerant while preventing refrigerant overcharge.

The present invention is not limited to the above-described embodiment, and may accommodate various modifications and improvements without departing from its scope. In the example of the refrigeration device 10 explained in the present embodiment, for instance, the outdoor heat exchanger 16 functions as a condenser, and the indoor heat exchanger 22 functions as an evaporator. However, the embodiment is not limited thereto. For instance, the outdoor heat exchanger 16 and the indoor heat exchanger 22 may also function as a condenser or as an evaporator by providing a directional control valve (not shown) in the refrigerant circuit 12, so that the refrigeration device becomes an air conditioner capable of heating and cooling.

In the embodiment above, the correction control unit 54 estimates the wetness of the refrigerant on the suction side on the basis of the superheat of refrigerant on the discharge side. However, the embodiment is not limited thereto. For instance, the correction control unit 54 may also measure directly the wetness of the refrigerant on the suction side of the compressor 14.

Figure 4:
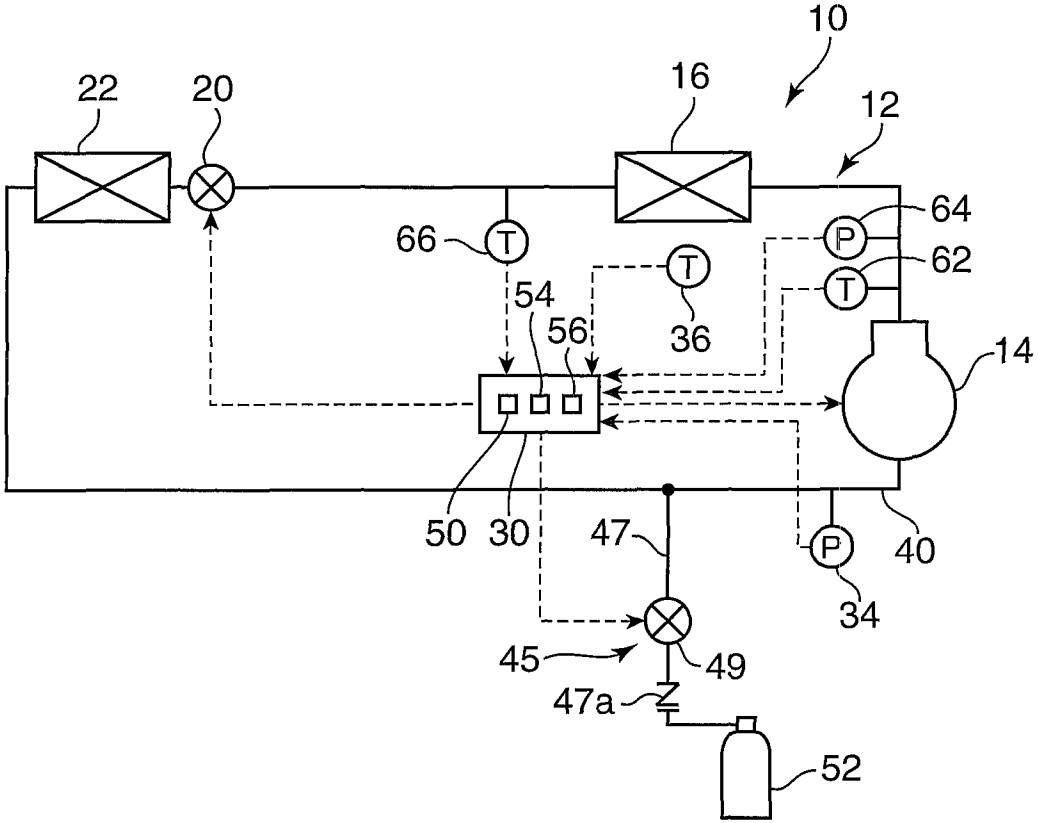
FIG. 4 is a diagram illustrating the schematic configuration of a refrigeration device according to another embodiment of the present invention.

In the embodiment above, the amount of charged refrigerant is detected by the level sensor 42, but the embodiment is not limited thereto. As illustrated in FIG. 4, for instance, the high-pressure side pressure sensor 64 on the discharge side of the compressor 14 and a liquid refrigerant temperature sensor 66 provided at the condenser outlet (outlet of the indoor heat exchanger 22) can be used to determine the refrigerant charge amount on the basis of the temperature difference between the saturation temperature corresponding to the pressure detected by the high-pressure side pressure sensor 64 and the refrigerant temperature detected by the liquid refrigerant temperature sensor 66, i.e. on the basis of supercooling at the condenser outlet. In this case, the tank 18 can be omitted.

Overview of the Embodiments

An overview of the embodiments is explained below.

(1) Conventionally, refrigerant is supplied to the suction side of a compression mechanism at a flow rate in accordance with the pressure difference between the pressure of the refrigerant supplied to the supply pipe and the refrigerant pressure on the suction side of the compression mechanism. In such a configuration, the refrigerant flow rate drops when, for instance, there decreases the pressure of the refrigerant supplied to the supply pipe. In the refrigerant charging device of the present embodiment, however, the adjustment means adjusts the flow rate in such a manner that the refrigerant flow rate in the supply pipe lies within a predetermined range, on the basis of the above-mentioned pressure difference. This allows curtailing, as a result, a decrease in the flow rate that is supplied to the refrigerant piping, even in case of a drop of pressure in the refrigerant supplied to the supply pipe. Therefore, it becomes possible to curtail the drop in charging speed of the refrigerant also in circumstances where, for instance, there decreases the pressure difference between the pressure in a cylinder and the pressure on the suction side of the compression mechanism. This allows avoiding, as a result, a protracted charging time.

(2) When the refrigerant charging device comprises an outdoor air temperature detection portion for detecting outdoor air temperature and pressure detection portion for detecting refrigerant pressure on the suction side of the compression mechanism, preferably, the adjustment portion adjusts the flow rate in the supply pipe based on a pressure difference between a saturation pressure corresponding to the outdoor air temperature detected by the outdoor air temperature detection portion, and refrigerant pressure detected by the pressure detection portion. Herein, the pressure of the refrigerant supplied to the supply pipe is estimated based on the detection value by the outdoor air temperature detection portion. Therefore, the refrigerant flow rate can be adjusted even if there is provided no means for detecting the pressure of the refrigerant that is supplied to the supply pipe. For instance, the temperature in the cylinder that is filled with refrigerant is found to be substantially the same as the outdoor air temperature. Accordingly, the pressure (saturation pressure) of the refrigerant that is supplied from the cylinder to the supply pipe can be estimated if the outdoor air temperature is known.

(3) Preferably, the adjustment portion comprises an electric valve provided in the supply pipe, and a flow rate control unit that controls the degree of opening of the electric valve. Herein, the flow rate of refrigerant flowing in the supply pipe can be adjusted through adjustment of the degree of opening of the electric valve by the flow rate control unit.

(4) Preferably, the refrigerant charging device has a correction control unit for correcting the degree of opening of the electric valve, controlled by the flow rate control unit, in such a manner that superheat of refrigerant on the discharge side of the compression mechanism becomes equal to or greater than a predetermined value. When the refrigerant flow rate is adjusted through adjustment of the degree of opening of the electric valve, the degree of reduced pressure in the refrigerant and the wetness of the refrigerant change both according to the degree of opening of the electric valve. Herein, however, adjustment is carried out in such a manner that superheat of refrigerant on the discharge side of the compression mechanism is kept equal to or greater than a predetermined value. As a result, refrigerant wetness occurring on the suction side of the compression mechanism can be kept within a predetermined wetness range.

(5) Preferably, the correction control unit increases the degree of opening of the electric valve when the superheat of refrigerant on the discharge side of the compression mechanism reaches an upper limit equal to or greater than the above-mentioned predetermined value. Herein, the superheat of refrigerant on the discharge side of the compression mechanism is kept within a predetermined range. This allows securing a predetermined superheat while preventing an excessive drop in the flow rate of refrigerant being supplied through the supply pipe.

(6) The superheat of refrigerant on the discharge side of the compression mechanism may be derived from a saturation temperature corresponding to refrigerant pressure and the refrigerant temperature on the discharge side of the compression mechanism. When there are provided means for detecting the temperature and means for detecting the pressure of refrigerant in the discharge side of the compression mechanism, thus, the superheat of refrigerant can be derived by using detection values from the detection means.

(7) Preferably, the refrigerant charging device comprises a charging completion control unit that closes the electric valve when a predetermined amount of refrigerant is supplied via the supply pipe. This allows charging a necessary amount of refrigerant while preventing refrigerant overcharge.

(8) The present embodiment is a refrigeration device comprising a refrigerant circuit in which refrigerant circulates between a compression mechanism, a condenser, an expansion mechanism and an evaporator; and the above-described refrigerant charging device, wherein the supply pipe of the refrigerant charging device is connected to refrigerant piping between the compression mechanism and the evaporator.

(9) The present embodiment is a refrigerant charging method for charging refrigerant via a supply pipe that is connected to refrigerant piping on the suction side of a compression mechanism in a refrigerant circuit, comprising the step of supplying refrigerant to the refrigerant circuit while adjusting the flow rate in such a manner that the flow rate in the supply pipe lies within a predetermined range, based on a pressure difference between the pressure of refrigerant supplied to the supply pipe and refrigerant pressure on the suction side of the compression mechanism. When refrigerant is supplied to the suction side of a compression mechanism at a flow rate corresponding to the pressure difference between the pressure of the refrigerant supplied to the supply pipe and the refrigerant pressure on the suction side of the compression mechanism, the refrigerant flow rate drops when, for instance, there decreases the pressure of the refrigerant supplied to the supply pipe. In the present embodiment, however, adjusting the flow rate in such a manner that the refrigerant flow rate in the supply pipe lies within a predetermined range, on the basis of the above-mentioned pressure difference, allows curtailing a decrease in the flow rate that is supplied to the refrigerant piping, even in case of a drop of pressure in the refrigerant supplied to the supply pipe. Therefore, it becomes possible to curtail the drop in charging speed of the refrigerant also in circumstances where, for instance, there decreases the pressure difference between the pressure in a cylinder and the pressure on the suction side of the compression mechanism. This allows avoiding, as a result, a protracted charging time.

(10) In the above-described refrigerant charging method, preferably, the flow rate in the supply pipe is adjusted on the basis of a pressure difference between saturation pressure corresponding to outdoor air temperature, and refrigerant pressure on the suction side of the compression mechanism. Herein, the saturation pressure corresponding to the outdoor air temperature is used as the pressure of the refrigerant supplied to the supply pipe. Therefore, the refrigerant flow rate can be adjusted even if there is provided no means for detecting the pressure of the refrigerant that is supplied to the supply pipe. For instance, the temperature in the cylinder that is filled with refrigerant is found to be substantially the same as the outdoor air temperature. Accordingly, the pressure (saturation pressure) of the refrigerant that is supplied from the cylinder to the supply pipe can be estimated if the outdoor air temperature is known.

(11) In the above-described refrigerant charging method, preferably, refrigerant is supplied to the refrigerant circuit while the flow rate is being adjusted in such a manner that the refrigerant flow rate in the supply pipe lies within a predetermined range through adjustment of the degree of opening of an electric valve provided in the supply pipe.

(12) In the above-described refrigerant charging method, preferably, the degree of opening of the electric valve is corrected in such a manner that superheat of refrigerant on the discharge side of the compression mechanism becomes equal to or greater than a predetermined value. When the refrigerant flow rate is adjusted through adjustment of the degree of opening of the electric valve, the degree of reduced pressure in the refrigerant, and the superheat of refrigerant on the discharge side of the compression mechanism change both according to the degree of opening of the electric valve. Herein, however, adjustment is carried out in such a manner that superheat of refrigerant on the discharge side of the compression mechanism is kept equal to or greater than a predetermined value. Therefore, refrigerant wetness occurring on the suction side of the compression mechanism can be kept within a predetermined wetness range.

(13) In the above-described refrigerant charging method, more preferably, the degree of opening of the electric valve is increased when the superheat of refrigerant on the discharge side of the compression mechanism reaches an upper limit equal to or greater than the predetermined value. Herein, the superheat of refrigerant on the discharge side of the compression mechanism is kept within a predetermined range. This allows securing a predetermined superheat while preventing an excessive drop in the flow rate of refrigerant being supplied through the supply pipe.

(14) In the above-described refrigerant charging method, preferably, the electric valve is closed when a predetermined amount of refrigerant is supplied via the supply pipe. This allows charging a necessary amount of refrigerant while preventing refrigerant overcharge.

As explained above, the embodiments allow suppressing variation in the charging time of refrigerant into a refrigerant circuit.

The invention claimed is:

1. A refrigerant charging device which supplies refrigerant to a refrigerant circuit via a supply pipe, the refrigerant charging device comprising:

a supply pipe connectable to refrigerant piping on a suction side of a compression mechanism in the refrigerant circuit;

outdoor air temperature detection portion that detects outdoor air temperature;

a pressure detection portion that detects refrigerant pressure on the suction side of the compression mechanism; and an adjustment portion including an electric valve provided in the supply pipe, and a flow rate control unit that derives a pressure difference between a pressure of the refrigerant to be supplied to the supply pipe as a saturation pressure corresponding to the outdoor air temperature and the detected refrigerant pressure on the suction side of the compression mechanism, derives a degree of opening of the electric valve at which a refrigerant flow rate in the supply pipe is substantially constant with respect to the derived pressure difference so as to increase the degree of opening of the electric valve as the pressure difference decreases using previously stored data that maps pressure difference between the pressure of the refrigerant to be supplied to the supply pipe and the refrigerant pressure on the suction side of the compression mechanism to Cv values of the electric valve, and adjusts a flow rate in the supply pipe to be within a predetermined range by adjusting the degree of opening of the electric valve to the derived degree of the opening of the electric valve.

2. The refrigerant charging device according to claim 1, further comprising a correction control unit for correcting the degree of opening of the electric valve, controlled by the flow rate control unit, such that superheat of refrigerant on the discharge side of the compression mechanism becomes equal to or greater than a predetermined value.

3. The refrigerant charging device according to claim 2, wherein the correction control unit increases the degree of opening of the electric valve when the superheat of the refrigerant on the discharge side of the compression mechanism reaches an upper limit equal to or greater than the predetermined value.

4. The refrigerant charging device according to claim 2, wherein the superheat of the refrigerant on the discharge side of the compression mechanism is derived from refrigerant temperature and a saturation temperature corresponding to refrigerant pressure on the discharge side of the compression mechanism.

5. The refrigerant charging device according to claim 1, further comprising a charging completion control unit that closes the electric valve when a predetermined amount of refrigerant is supplied via the supply pipe.

6. A refrigeration device comprising:

a refrigerant circuit in which refrigerant circulates between a compression mechanism, a condenser, an expansion mechanism and an evaporator; and the refrigerant charging device according to claim 1, wherein the supply pipe of the refrigerant charging device is connected to refrigerant piping between the compression mechanism and the evaporator.

7. A refrigerant charging method for charging refrigerant via a supply pipe that is connected to refrigerant piping on a suction side of a compression mechanism in a refrigerant circuit while adjusting an opening of an electric valve provided in the supply pipe, the method comprising:

detecting a refrigerant pressure on the suction side of the compression mechanism by a pressure detecting portion;

estimating a pressure of the refrigerant supplied to the supply pipe by deriving a saturation pressure corresponding to an outdoor air temperature detected by an outdoor air temperature detection portion;

deriving a pressure difference between the pressure of the refrigerant to be supplied to the supply pipe and the detected refrigerant pressure on the suction side of the compression mechanism;

deriving a degree of opening of the electric valve at which a refrigerant flow rate in the supply pipe is substantially constant with respect to the derived pressure difference so as to increase the degree of opening of the electric valve as the pressure difference decreases using previously stored data that maps pressure difference between the pressure of the refrigerant to be supplied to the supply pipe and the refrigerant pressure on the suction side of the compressor to Cv values of the electric valve; and supplying the refrigerant to the refrigerant circuit while adjusting a flow rate in the supply pipe to be within a predetermined range by adjusting the degree of opening of the electric valve to the derived degree of the opening of the electric valve.

8. The refrigerant charging method according to claim 7, further comprising:

correcting the derived degree of opening of the electric valve such that superheat of the refrigerant on the discharge side of a compression mechanism is equal to or greater than a predetermined value.

9. The refrigerant charging method according to claim 8, wherein the degree of opening of the electric valve is increased when the superheat of the refrigerant on the discharge side of the compression mechanism reaches an upper limit equal to or greater than the predetermined value.

10. The refrigerant charging method according to claim 7, further comprising:

closing the electric valve when a predetermined amount of refrigerant is supplied to the refrigerant circuit via the supply pipe.

* * * * *